US011170987B1

(12) United States Patent
Kuno et al.

(10) Patent No.: US 11,170,987 B1
(45) Date of Patent: Nov. 9, 2021

(54) SHORT-ARC DISCHARGE LAMP

(71) Applicant: Ushio Denki Kabushiki Kaisha, Tokyo (JP)

(72) Inventors: Akihiro Kuno, Tokyo (JP); Keiichi Maeda, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/340,095

(22) Filed: Jun. 7, 2021

(30) Foreign Application Priority Data

Jul. 27, 2020 (JP) ..... JP2020-126666

(51) Int. Cl.
*H01J 61/073* (2006.01)
*H01J 61/82* (2006.01)
*H01J 61/52* (2006.01)

(52) U.S. Cl.
CPC ..... *H01J 61/0735* (2013.01); *H01J 61/526* (2013.01); *H01J 61/822* (2013.01)

(58) Field of Classification Search
CPC ..... H01J 61/0735; H01J 61/526; H01J 61/822
See application file for complete search history.

(56) References Cited

U.S. PATENT DOCUMENTS

2021/0050207 A1* 2/2021 Winzek ..... H01J 61/0735

FOREIGN PATENT DOCUMENTS

DE 102018207038 A1 * 11/2019 ..... H01J 61/0735
JP 2004-259639 A 9/2004

* cited by examiner

*Primary Examiner* — Donald L Raleigh
(74) *Attorney, Agent, or Firm* — Kenichiro Yoshida

(57) ABSTRACT

The short-arc discharge lamp includes a pair of electrodes arranged facing each other inside a light-emitting tube, the pair of electrodes made of a material containing tungsten; a coating formed on the first outer surface of at least one of the pair of electrodes, the coating made of a material containing ceramics; and tungsten particles adhered to a part of the second outer surface of the coating.

6 Claims, 5 Drawing Sheets

SHORT-ARC DISCHARGE LAMP

TECHNICAL FIELD

The present invention relates to a short-arc discharge lamp.

BACKGROUND ART

Short-arc discharge lamps (hereinafter referred to simply as "lamps") are used as light sources for exposure systems in manufacturing processes of semiconductor device, liquid crystal displays and so forth, and for various types of projectors. The short-arc discharge lamp includes a light-emitting tube in which an anode and a cathode are arranged facing each other and a light-emitting substance such as mercury or xenon gas is sealed.

In this short-arc discharge lamp, since the thermal load is highly applied to the anode during lighting, the electrode material evaporates mainly caused by the overheating of the anode. The evaporated material adheres to the inner wall of the light-emitting tube, resulting in a decrease in light transmittance, which is known as blackening.

In order to solve this problem, a technology has been known to form a heat radiation layer on the electrode surface to reduce the temperature rise of the electrodes. The following Patent Document 1 discloses a lamp in which a heat radiation layer made of a material containing at least one type of metal oxides is formed on the outer surface of the electrode except near its tip.

CITATION LIST

Patent Document

Patent Document 1: JP-A-2004-259639

SUMMARY OF INVENTION

Technical Problem

However, even when the temperature rise of the electrode is properly reduced, as in the case of the lamp described in Patent Document 1, the evaporation of the electrode material does not completely disappear; the tungsten, which is an electrode material, gradually evaporates to blacken the inner wall of the light-emitting tube. Lamps have been demanded to last for longer operating hours in recent years, thus the problem of reducing the blackening on the inner wall of the light-emitting tube needs further improvement.

In view of the above problem, an object of the present invention is to provide a long-life short-arc discharge lamp with effective heat radiation properties and the reduced blackening of the inner wall of the light-emitting tube, the lamp including a light-emitting tube having a pair of electrodes having a first outer surface and arranged facing each other therein, and a coating being formed on the first outer surface of at least one of the pair of electrodes.

Solution to Problem

A short-arc discharge lamp according to the present invention includes a pair of electrodes arranged facing each other inside a light-emitting tube; the pair of electrodes having a first outer surface and made of a material containing tungsten, and a coating formed on the first outer surface of at least one of the pair of electrodes and having a second outer surface of the coating, the coating made of a material containing ceramics; and tungsten particles adhered to a part of the second outer surface of the coating.

This configuration allows the first outer surface of the electrode to be formed with the coating being made of a material containing ceramics, thus providing effective heat radiation properties. In addition, since the tungsten particles have been adhered to the part of the second outer surface of the coating, tungsten evaporated from the electrode during the lighting of the lamp adheres to the tungsten particles on the second outer surface of the coating. Hence, less amount of the tungsten evaporated from the electrode reaches the inner wall of the light-emitting tube through convection, reducing the amount of blackening. Therefore, the short-arc discharge lamp according to the present invention has a long lamp life due to the effective heat radiation properties and the reduced blackening on the inner wall of the light-emitting tube.

The short-arc discharge lamp of the present invention, which has a vertical lighting direction, may include a coating made of a material containing ceramics formed on the first outer surface of the electrode located upward out of the pair of the electrodes, and tungsten particles adhered to a part of the second outer surface of the coating.

This configuration allows the tungsten evaporated from the electrodes to adhere to the tungsten particles on the second outer surface of the coating of an upper one of the pair of electrodes, thus efficiently reducing the amount of tungsten that reaches the inner wall of the light-emitting tube through convection.

The short-arc discharge lamp according to the present invention may be configured that the upper electrode is an anode.

This configuration allows the tungsten evaporated from the electrodes to adhere to the tungsten particles on the second outer surface of the coating of the anode, which has a larger surface area than a cathode, thus efficiently reducing the amount of tungsten that reaches the inner wall of the light-emitting tube through convection.

The short-arc discharge lamps according to the present invention may be configured to allow the tungsten particles to cover from 3% to 40% of the second outer surface of the coating. (i.e. a coverage ratio of 3% to 40%) The "coverage ratio" refers to, for example, a ratio of the total area of tungsten particles W to the area of the coating.

This configuration allows the tungsten evaporated from the electrode to efficiently adhere to the tungsten particles on the second outer surface of the coating while the coating maintains its effective heat radiation properties.

The short-arc discharge lamp of the present invention may be configured to include at least one of the following ceramics: metal oxides, metal carbides, metal borides, metal silicides, and metal nitrides.

This configuration allows the coating to exhibit effective heat radiation properties as a high heat radiation coating.

DESCRIPTION OF EMBODIMENTS

Embodiments of a short-arc discharge lamp of the present invention is described with reference to the drawings. It is noted that the following drawings are merely schematically illustrated. In other words, the dimensional ratios on the drawings do not necessarily match the actual dimensional ratios, and the dimensional ratios between each drawing do not necessarily match either.

Hereinafter, the embodiments will be described with reference to a XYZ coordinate system as necessary. In the case of describing a direction to distinguish a positive direction from a negative direction, a positive or a negative sign is added to the direction, such as "+X direction" or "−X direction". In the case of describing a direction without distinguishing a positive direction from a negative direction, the direction is simply expressed as "X direction". In other words, the term "X direction" used in this specification refers to both "+X direction" and "−X direction". The same manner applies to Y direction and Z direction.

Figure 1:
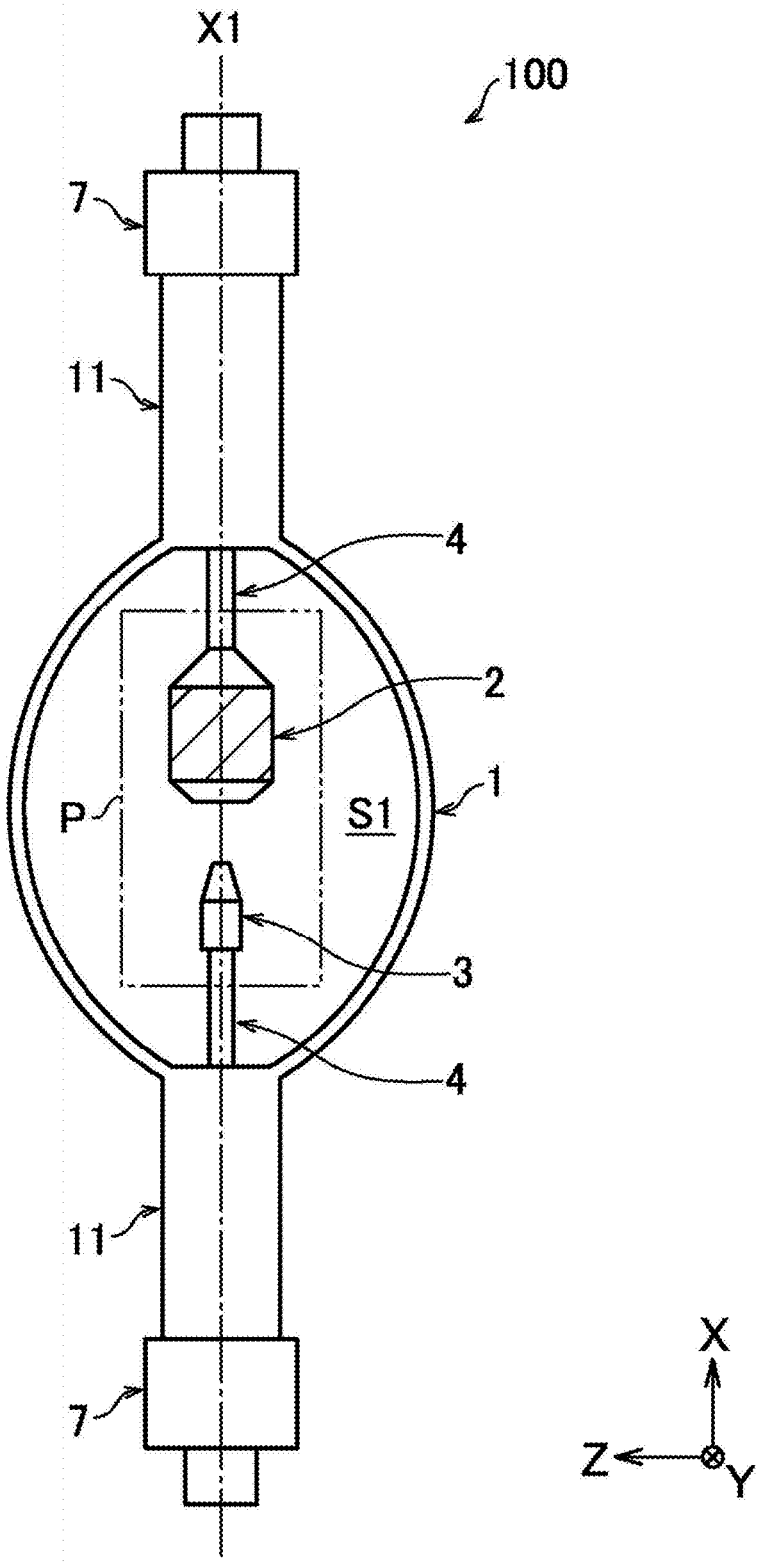
FIG. 1 is a diagram illustrating a configuration of a short-arc discharge lamp according to an embodiment of the present invention.

FIG. 1 is a diagram illustrating a configuration of a short-arc discharge lamp according to an embodiment of the present invention. A short-arc discharge lamp 100 (hereinafter referred to as "the lamp 100") includes a light-emitting tube 1, an anode 2 and a cathode 3 arranged facing each other inside the light-emitting tube 1, and lead rods 4 each supporting the anode 2 and the cathode 3.

The lamp 100 according to the present embodiment is a large power lamp used for exposure systems in the manufacturing process of semiconductor devices, liquid crystal displays and so forth. The rated power of the lamp is, for example, 2 kW to 35 kW.

The light-emitting tube 1 is formed by inflating the center of a glass tube. The light-emitting tube 1 has a spherical or ellipsoidal shape made of glass; and its inner diameter increases from the both ends of the light-emitting tube 1 in the X direction toward the center.

The light-emitting tube 1 has a pair of sealed tube sections 11 extending continuously in opposite directions from the both ends of the light-emitting tube 1 in the X direction. The light-emitting tube 1 is integrally formed with the sealed tube section 11 made of, for example, quartz glass. The central axes of the pair of sealed tube sections 11 overlap each other and are shown as the axis X1 in FIG. 1.

A light-emitting space S1 is formed inside the light-emitting tube 1. The light-emitting space S1 is filled with mercury and other light-emitting substances as well as buffer gases for start-up assistance such as argon gas and xenon gas as appropriate.

The anode 2 and the cathode 3 are arranged inside the light-emitting tube 1, facing each other in the X direction. In this embodiment, the short-arc discharge lamp is a discharge lamp in which the anode 2 and the cathode 3 are arranged facing each other with a gap of 40 mm or less. The gap is defined at room temperature without thermal expansion. In this embodiment, the anode 2 is made of tungsten and the cathode 3 is made of thorium oxide tungsten.

The anode 2 and the cathode 3 each are connected to the lead rods 4 that extend in the X direction inside the sealed tube sections 11. The anode 2 and the cathode 3 each are fixed to the tip of the lead rods 4. It is preferable that the central axis of the lead rods 4 overlap with the axis X1. The lead rods 4 are made of a material containing a high melting point metal, such as tungsten.

Bases 7 each cover the side of the sealed tube sections 11, the side being located away from the anode 2 and the cathode 3. Each of the base 7 is electrically connected to the corresponding lead rod 4.

Figure 2:
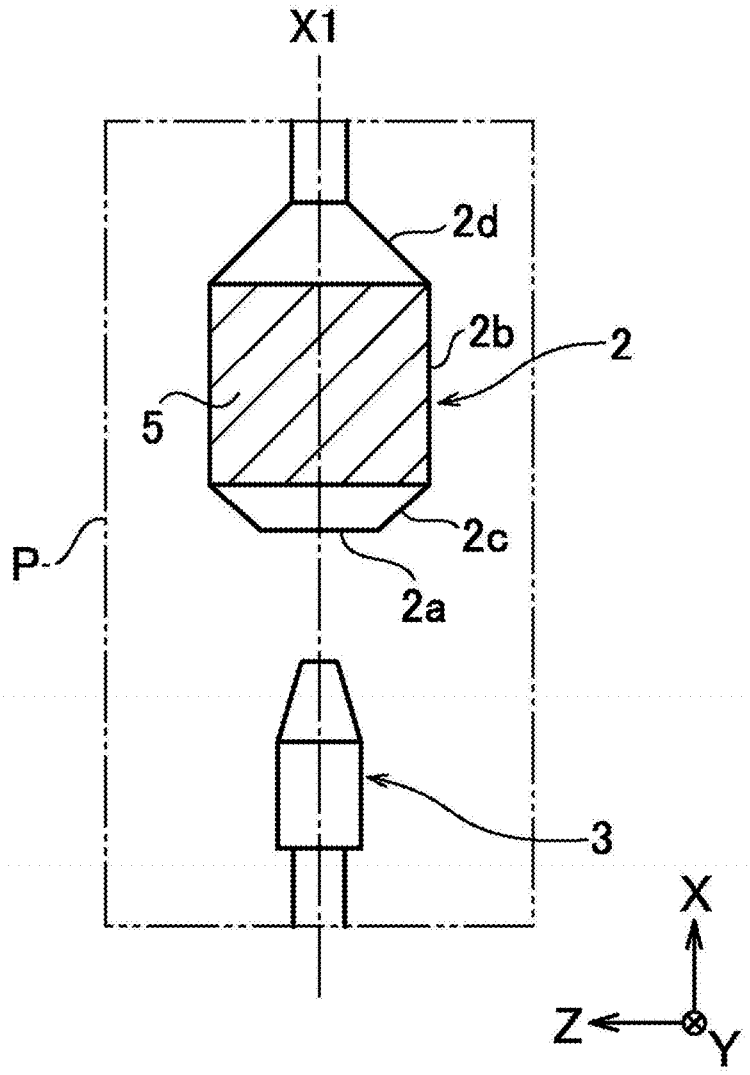
FIG. 2 is an enlarged view of the area P in FIG. 1.

FIG. 2 is an enlarged view of the area P in FIG. 1, illustrating the anode 2 and the cathode 3 of the lamp 100. The first outer surface of the anode 2 is formed with a coating 5 made of a material containing ceramics. Here, the first outer surface of the anode 2 refer to an outer surface excluding a tip surface 2*a* facing the cathode 3. In this embodiment, since the tip surface 2*a* of the anode 2 may rise in temperature to above the melting point of the coating 5 when the lamp 100 is lit, the anode 2 is not provided with the coating 5 at the tip surface 2*a* thereof. In this embodiment, the coating 5 is provided, among the first outer surface of the anode 2, on an outer circumferential surface 2*b* of the cylindrical body centered around the axis X1; however the coating 5 may also be provided on a tapered surface 2*c* located between the outer surface 2*b* and the tip surface 2*a*. Moreover, the coating 5 may be provided on a rear tapered surface 2*d* located on the +X side from the outer circumferential surface 2*b* of the anode 2.

The materials of the coating 5 have important properties including melting points, vapor pressures, emissivities, and thermal expansion coefficients. It is desirable that the coating 5 be made of a material with a high emissivity to increase the amount of heat radiation, thus lowering the temperature of the anode 2.

The coating 5 is made of a material containing ceramics. The ceramics include at least one of the following: metal oxides, metal carbides, metal borides, metal silicides, and metal nitrides. The coating 5 can be made of any materials with a melting point of 2000° C. or higher, for example, aluminum oxide, zirconium oxide ($ZrO_2$), zirconium carbide (ZrC), zirconium boride ($ZrB_2$), tantalum silicide ($TaSi_2$), and zirconium nitride (ZrN).

The coating 5 is formed on the anode 2, for example, by dispersing particles of the material constituting the coating 5 (e.g., particles of zirconium oxide ($ZrO_2$) having a particle diameter of 10 μm or less) in a solvent (e.g., a solvent consisting of nitrocellulose and butyl acetate), applying this dispersed solution to the outer circumferential surface 2*b* of the anode 2 with a brush, drying the applied solution at 150° C. for 30 minutes, then heating the anode 2 at 1900° C. for 120 minutes under a vacuum environment. The coating 5 preferably has a thickness of 5 μm or more and 200 μm or less. The coating having a thinner thickness does not achieve a sufficient emissivity. The coating having a thicker thickness easily peels off.

Figure 3A:
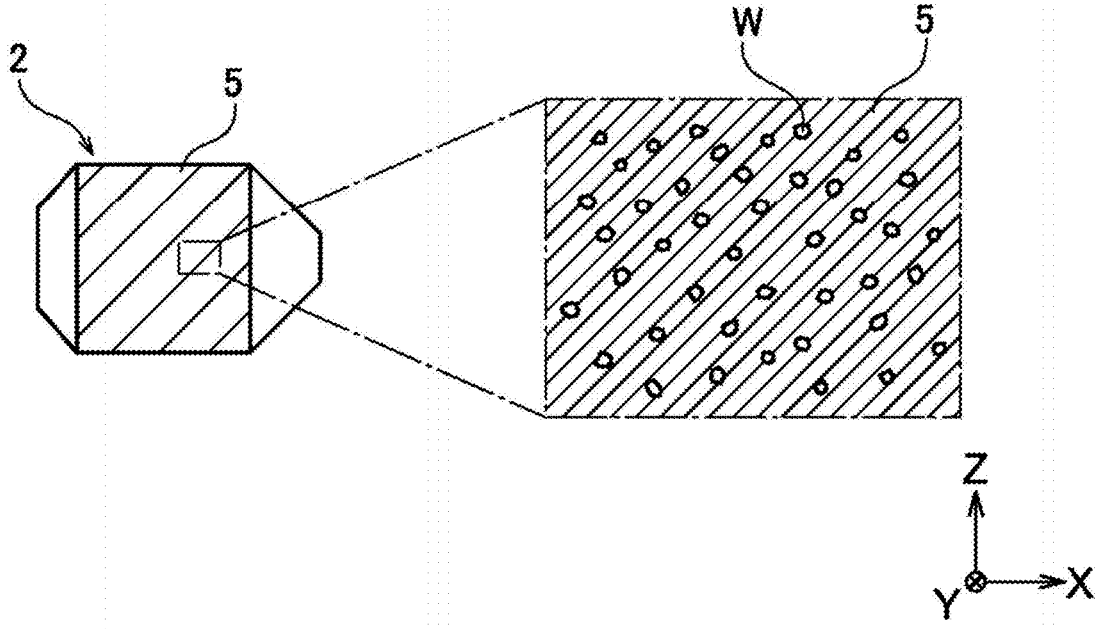
FIG. 3A is an enlarged view of the first outer surface of an anode.
Figure 3B:
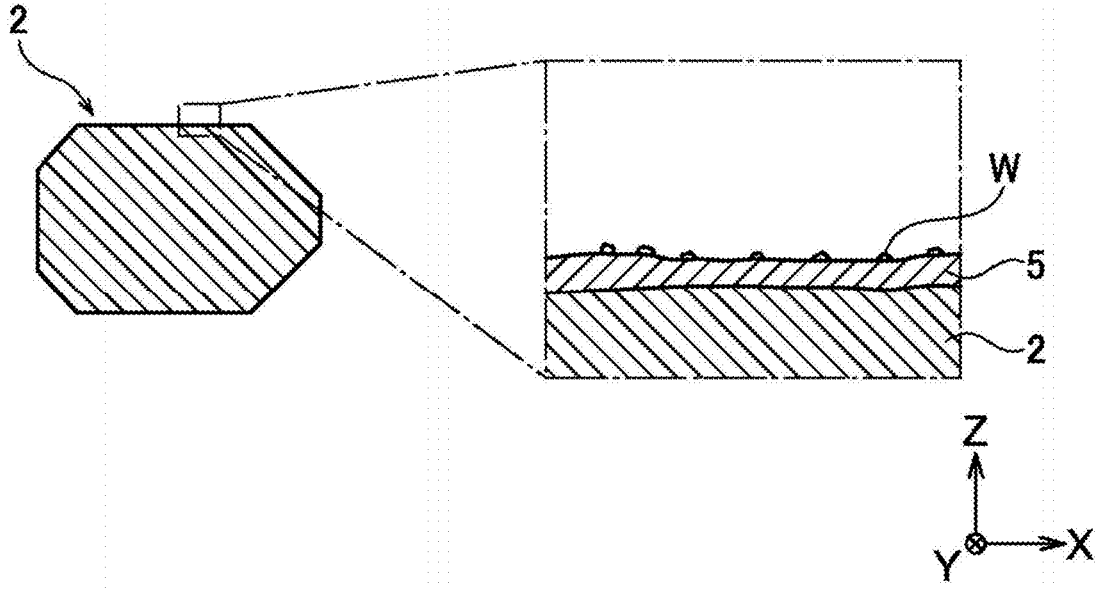
FIG. 3B is an enlarged cross-sectional view of the first outer surface of the anode.
Figure 3C:
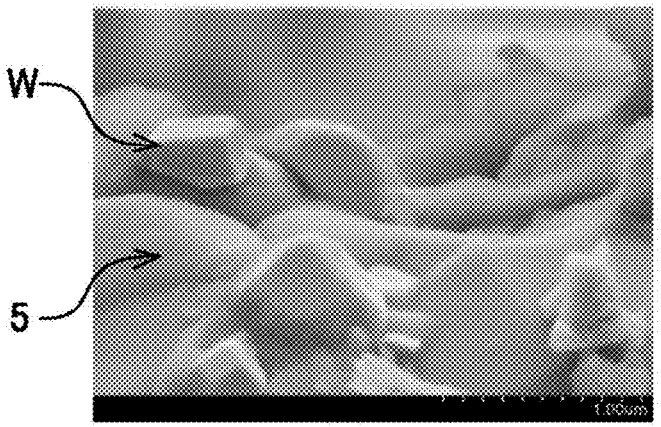
FIG. 3C is an enlarged image of the first outer surface of the anode taken with a Scanning Electron Microscope.

FIG. 3A is an enlarged view of the first outer surface of the anode 2. FIG. 3B is an enlarged cross-sectional view of the first outer surface of the anode 2. FIG. 3C is an enlarged image of the first outer surface of the anode 2 taken with a Scanning Electron Microscope.

As shown in FIGS. 3B and 3C, the coating 5 is formed on the first outer surface of the anode 2 made of tungsten, and provided with tungsten particles W adhered on a part of the coating 5. The tungsten particles W are indicated as white spots in FIG. 3A and, are scattered to cover the part of the coating 5. The tungsten particles W have a particle size of 0.1 μm to 10 μm.

The coverage ratio of the tungsten particles W to the area of the coating 5 is preferably 3% to 40%. The coverage ratio refers to a ratio of the total area covered with the tungsten particles W to the area of the coating 5.

The tungsten particles W are formed on the second outer surface of the coating 5 by vacuum vapor deposition. For example, in the process of sintering zirconium oxide ($ZrO_2$) that has been coated on the electrode, the electrode is placed in a furnace and energized to raise the temperature of the electrode itself acting as a heater, and the furnace is vacuumed with an elevated temperature. This process is equivalent to vacuum vapor deposition of a resister heating type; in other words, the tungsten, which is a material for vapor deposition, is heated by an electrical current to deposit the tungsten particles W on the second outer surface of the coating 5.

The vacuum vapor deposition of tungsten by the electrical current heating may be performed separately after the sintering of zirconium oxide ($ZrO_2$). Separating the tungsten vapor deposition from the sintering of zirconium oxide ($ZrO_2$) allows the coverage ratio of tungsten particles W to be easily adjusted.

Figure 4:
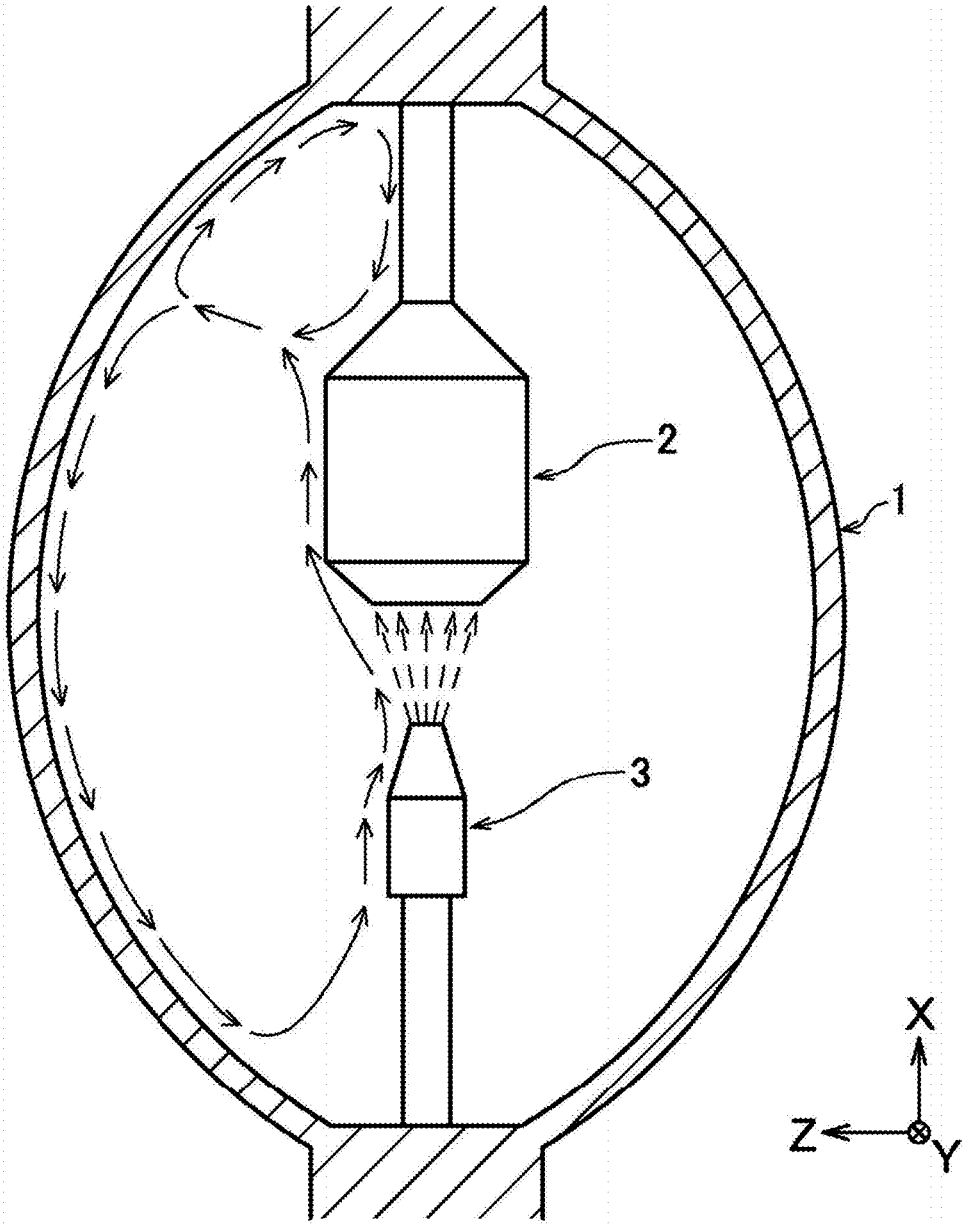
FIG. 4 is a diagram illustrating evaporation of tungsten contained in electrodes and its adhesion to the inner wall of a light-emitting tube.

With reference to FIG. 4, the blackening of the inner wall of the light-emitting tube will now be explained. In FIG. 4, the arrows shown in dashed lines represent arc discharge during lamp lighting, and the arrows shown in solid lines represent the flow (convection) of the light-emitting gas.

The arc discharge, which is very hot, causes a part of the electrodes (the anode 2 and the cathode 3) to evaporate. The evaporated electrode component (tungsten) travels along the flow of the light-emitting gas. The evaporated tungsten adheres to surfaces such as the inner wall of the light-emitting tube 1 while traveling along the flow of light-emitting gas. The tungsten adhered to the inner wall of the light-emitting tube 1 has come to a black substance that prevents light from transmitting.

As shown in FIG. 4, the light-emitting gas rises along the anode 2, then reaches the inner wall of the light-emitting tube 1 to change its direction and circulate around the light-emitting tube 1. Hence, the evaporated tungsten adheres to the inner wall of the light-emitting tube 1, and also to the side of the electrode in normal cases.

However, when the coating 5 mainly composed of ceramics is provided on the electrode surface, the evaporated tungsten is less likely to adhere to the coating 5. Since tungsten is formed with metal bonding and ceramics is formed with covalent bonding, metals and ceramics do not bond chemically.

In contrast, the coating 5 in the lamp 100 of the present invention has tungsten particles W attached to the second outer surface thereof. The tungsten particles W attached to the second outer surface of the coating 5 serve as nuclei and incorporate the evaporated tungsten into the particles to grow crystals. Therefore, the amount of tungsten reaching the inner wall of the light-emitting tube 1 decreases, thus reducing the amount of blackening on the light-emitting tube 1.

Note, however, that the emissivity of the second outer surface of the coating 5 is reduced to the extent that the tungsten particles W covers a part of the second outer surface of the coating 5. In other words, the temperature of the electrode tip with the tungsten particles W is higher than that of the electrode tip without the tungsten particles W, thus the material at the electrode are more likely to evaporate. For this reason, the coverage ratio of the tungsten particles W needs to be optimized to satisfy the following condition that the amount of the evaporated material collected by the tungsten particles W exceeds the amount of the evaporated material from the electrode caused by the decrease in emissivity.

In the lamp 100 according to the embodiment, the coverage ratio of the tungsten particles W to the second outer surface of the coating 5 may range from 3% to 40%. This coverage range allows the tungsten particles W on the second outer surface of the coating 5 to effectively collect the tungsten evaporated from the electrode while ensuring the effective heat radiation property by the coating 5.

As described above, the lamp 100 of the present invention has the effective heat radiation properties and reduces the blackening of the inner wall of the light-emitting tube 1, thereby extending the service life of the lamp 100.

EMBODIMENT

Hereinafter, examples and other details demonstrating concretely the configurations and effects of the present invention are described.

The coating with tungsten particles W was formed as follows. Zirconium oxide ($ZrO_2$) powder having a particle size of 10 μm or less was added to a solvent consisting of nitrocellulose and butyl acetate and mixed well, then the mixture was applied to the outer circumferential surface of the anode with a brush. The applied mixture was dried at 150° C. for 30 minutes and heat-treated at 1900° C. for 120 minutes with tungsten in a vacuum environment to form the coating with tungsten particles W.

Lamps with different coverage ratios of the tungsten particles W to the second outer surface of the coating made of a material containing zirconium (coverage ratios of 0%, 3%, 10%, 40%, and 50%) were used to evaluate the effect of reducing the amount of blackening of the light-emitting tube.

The coverage ratio of the tungsten particles W was calculated by observing the mapping images of tungsten in the surface analysis of a scanning electron microscope equipped with an energy dispersive X-ray system (EDS). The mapping analysis was performed by the EDS in an area of 20 μm×20 μm and the coverage ratio was defined as the ratio of the area of tungsten particles W to the area of 20 μm×20 μm.

The decrease in the amount of blackening of the light-emitting tube was evaluated by calculating illuminance maintenance rate of the light having a wavelength of 365 nm as a measurement subject. Here, the illuminance maintenance rate refers to a ratio of the illuminance of a predetermined wavelength after lighting for a given period of time to the illuminance at the start of lighting, and expressed as a percentage with respect to the illuminance at the start of lighting.

In the present experiment, the illuminance of the lamps at the start of lighting was measured with a photo detector sensitive to a wavelength of 365 nm. Next, the illuminance of the lamps after 2000 hours of continuous lighting at the rated power was measured, and the ratio of the illuminance after 2000 hours of continuous lighting to the initial illuminance was calculated as the illuminance maintenance rate. The results are shown in Table 1.

TABLE 1

| Coverage ratio of tungsten particles W | 0% | 3% | 10% | 40% | 50% |
|---|---|---|---|---|---|
| Illuminance maintenance rate after 200 hours | 90% | 92% | 94% | 92% | 90% |

As shown in Table 1, the illuminance maintenance rate improved in the coverage ratio of 3-40% compared to the case of no tungsten particles adhered (i.e. coverage ratio of 0%). In contrast, in the case of the coverage ratio being 50%, the illuminance maintenance rate was the same as that of the case of no tungsten particles adhered; thus no improvement was obtained.

The details of the lamp specification are as follows.

[Discharge Vessel]
Material: Quartz glass
Total length: 120 mm
Maximum outer diameter: 95 mm
Maximum inner diameter: 85 mm

[Anode]
Material: Tungsten
Outer diameter: 35 mm
Total length: 50 mm

[Cathode]
Material: Thorium oxide tungsten
Outer diameter: 12 mm
Total length: 35 mm

[Luminescent Material]
Material: Mercury
Amount: 3 g

[Buffer Gas]
Material: Krypton
Gas pressure: 4 atm

[Gap]
Distance between anode tip and cathode tip: 7 mm

[Electrical Characteristics]
Rated power: 4.5 kW
Rated voltage: 145 V
Rated current: 31 A

[Lighting Direction]
Vertical lighting

The embodiments of the present invention have been described above with reference to the drawings; however, it should be noted that the specific configuration is not limited to these embodiments. The scope of the present invention is indicated by the claims as well as the description of the embodiments described above, and further includes all modifications within the scope of the claims and the meaning of equivalents.

The configuration employed in each of the above embodiments can be employed in any other embodiments. The specific configuration of each component is not limited to the embodiment described above, but can be modified in various ways without departing from the scope of the present invention. In addition, any one or more of the configurations and methods described below may be selected and employed for the configurations and methods described in the above embodiments.

[1] In the above embodiments, the coating 5 is provided only on the first outer surface of the anode 2; however, the coating 5 may also be provided on the first outer surface of the cathode 3, or only on the first outer surface of the cathode 3.

[2] In the above embodiments, the lamp 100 used as an example has a vertical lighting direction; however, the lamp with a horizontal lighting direction can also have the effect of reducing the amount of blackening of the light-emitting tube, since the flow of light-emitting gas along the electrodes also occurs in the case of the lamp with the horizontal lighting direction.

What is claimed is:

1. A short-arc discharge lamp having a light-emitting tube, the short-arc discharge lamp comprising:

a pair of electrodes arranged facing each other inside the light-emitting tube, the electrodes having a first outer surface and made of a material containing tungsten;

a coating formed on the first outer surface of at least one of the pair of electrodes and having a second outer surface of the coating, the coating made of a material containing ceramics; and tungsten particles adhered to a part of the second outer surface of the coating.

2. The short-arc discharge lamp according to claim 1, wherein the short-arc discharge lamp has a vertical lighting direction.

3. The short-arc discharge lamp according to claim 2, wherein the coating is formed on the first outer surface of an upper one of the pair of the electrodes, and is made of a material containing ceramics; and the tungsten particles are adhered to a part of the second outer surface of the coating.

4. The short-arc discharge lamp according to claim 3, wherein the upper electrode is an anode.

5. The short-arc discharge lamp according to claim 1, wherein a coverage ratio of the tungsten particles to the second outer surface of the coating ranges from 3% to 40%.

6. The short-arc discharge lamp according to claim 1, wherein the ceramics include at least one of the materials including metal oxides, metal carbides, metal borides, metal silicides, and metal nitrides.

* * * * *